US005697313A

United States Patent [19]

Horn et al.

[11] Patent Number: 5,697,313

[45] Date of Patent: Dec. 16, 1997

[54] BARGE AND WALKWAY CONNECTION SYSTEM

[75] Inventors: Dennis W. Horn, Glendale, Ariz.; Matthew Sheperd, Vancouver, Wash.

[73] Assignee: Laird Plastics, Inc., Seattle, Wash.

[21] Appl. No.: 527,752

[22] Filed: Sep. 13, 1995

[51] Int. Cl.[6] ..... B63B 3/08

[52] U.S. Cl. ..... 114/77 R; 114/266

[58] Field of Search ..... 114/77 R, 266, 114/26, 263, 44, 45; 405/219, 220; 14/27

[56] References Cited

U.S. PATENT DOCUMENTS

| | | | |
|---|---|---|---|
| 2,518,091 | 8/1950 | Stopkevyc | 114/266 |
| 2,924,191 | 2/1960 | Blumquist et al. | 114/266 |
| 3,035,536 | 5/1962 | Archer | 114/77 R |
| 3,073,274 | 1/1963 | Lamb | 114/266 |
| 3,145,681 | 8/1964 | Nakagawa | 114/77 R |
| 3,152,568 | 10/1964 | Mayer | 114/266 |
| 3,492,825 | 2/1970 | Pearson . | |
| 3,603,276 | 9/1971 | De Lisle | 114/45 |
| 3,691,974 | 9/1972 | Selford, Sr. et al. . | |
| 3,763,808 | 10/1973 | Smith, Sr. . | |
| 4,223,629 | 9/1980 | Dunlop | 114/263 |
| 4,287,625 | 9/1981 | Dawson | 405/219 |
| 4,386,441 | 6/1983 | Lundholm | 14/27 |
| 4,493,284 | 1/1985 | Echtler | 114/267 |
| 4,641,595 | 2/1987 | Pritchett | 114/44 |
| 4,928,617 | 5/1990 | Meriwether | 114/267 |
| 5,044,829 | 9/1991 | Hemminger | 405/203 |
| 5,207,534 | 5/1993 | Brasted et al. | 405/209 |
| 5,213,447 | 5/1993 | Srock | 405/219 |

FOREIGN PATENT DOCUMENTS

| | | | |
|---|---|---|---|
| 1523455 | 5/1968 | France | 114/266 |

*Primary Examiner*—Sherman Basinger
*Attorney, Agent, or Firm*—Anthony R. Barkume

[57] ABSTRACT

A modular pump barge and walkway system having a modular subsystem of pump barges and a modular subsystem of walkways releasably attached thereto. Each of the pump barges has a top deck and four side walls, wherein each of two oppositely disposed side walls has a recess disposed therein with a bottom shelf and a pair of holes. Each of the barges has a link pin assembly for interconnecting with an adjacent barge, comprising a support plate and a pair of vertically disposed pins, the support plate arranged so as to be removably attachable to the top deck so as to cover the recess, the pins being disposed so as to be mated with and removably inserted into the pair of holes disposed within the bottom shelf of the recess when the support plate is attached to the top deck. A link plate has a pair of parallel slots juxtaposed so as to allow placement therethrough of the pins of the link pin assembly, the link plate being removably and slidably inserted between the support plate and the bottom shelf of the recess when the link pin assembly is attached to the barge. Thus, the link plate provides interconnection of adjacent barges with independent vertical translational movement therebetween. The modular subsystem of walkways also has a plurality of floating walkways interconnected to each other in serial fashion at each of two oppositely disposed ends thereof in pivotable hinged relationship therebetween.

4 Claims, 12 Drawing Sheets

BARGE AND WALKWAY CONNECTION SYSTEM

BACKGROUND OF THE INVENTION

The present invention relates generally to floating pump barges and walkways and in particular to a modular barge and walkway system with improved interconnection devices.

Pump barges are floating platforms typically used in the mining industry to support large pump and motor assemblies which transport solvent from a leaching pond to a processing plant. Walkways are platforms used to transport personnel between the shore and the barges as desired. In the past, pump barges were often constructed in a custom manner depending upon the requirements of a particular user; i.e. active sites having multiple pump requirements often necessitated large custom made barges to house the pumps. In addition, walkways were constructed to suit the layout of a particular job site and the designs were often not reusable.

When multiple barges and walkways were implemented in the past, most were interconnected by means of rope and cleat arrangements. Tying barges together with rope did not allow the barges to list, heel, or vertically translate independent of each other, which types of relative motion is often desirable in multiple barge environments. Tying walkways together with rope did not provide proper weight distribution amongst the various sections and led to unstable operating conditions.

It is therefore an object of the present invention to provide a pump barge and walkway system which overcomes these and other disadvantages of the prior art.

In particular, it is an object of the present invention to provide a modular pump barge and walkway system which is easily configured to the requirements of a particular setting and which can be configured and installed from a combination of readily available modular units as required.

It is a further object of the present invention to provide an improved means for interconnecting pump barges which allows for quick and simple interconnection of multiple barges.

It is a still further object of the present invention to provide an improved means for interconnecting floating walkways which allows for quick and simple interconnection of multiple walkway modules.

SUMMARY OF THE INVENTION

In accordance with these and other objects, provided is a modular pump barge and walkway system comprising a modular subsystem of pump barges, a modular subsystem of walkways, and means for releasably attaching the modular subsystem of pump barges with the modular subsystem of walkways to allow passage of personnel between the walkways and the barges. Within the barge subsystem, each of the pump barges has a top deck and four side walls, wherein each of two oppositely disposed side walls has a recess disposed therein. Each recess has a bottom shelf with a pair of holes disposed therein. Each of said barges has means for interconnection with adjacent ones of the barges, the interconnection means comprising a link pin assembly comprising a support plate and a pair of pins disposed perpendicularly thereto, the support plate arranged so as to be removably attachable to said top deck so as to cover the recess, the pins being disposed so as to be mated with and removably inserted into the pair of holes disposed within the bottom shelf of the recess when the support plate is attached to the top deck. The barge interconnection means also comprises a link plate comprising a pair of parallel slots juxtaposed so as to allow placement therethrough of the pins of the link pin assembly, the link plate being removably and slidably inserted between the link pin assembly and the bottom shelf of the recess when the link pin assembly is attached to the barge. As a result of this configuration, when the link plate is slidably inserted between the link pin assembly and the recess bottom shelf of each adjacent barge, the link plate provides interconnection of the barges with relative vertical translation therebetween.

The modular subsystem of walkways comprises a plurality of floating walkways interconnected to each other in serial fashion at each of two oppositely disposed ends thereof in pivotable hinged relationship therebetween. Each of the floating walkways comprises pivotable hinge connection assemblies at each end for mating with oppositely disposed pivotable hinge connection assemblies of adjacent walkways, each of the pivotable hinge connection assemblies comprising a plurality of hinge members integrally formed with the walkway. Each of the hinge members has bored therethrough an opening for receiving a hinge pin whereby the hinge pin allows for pivoting rotation thereabout.

DETAILED DESCRIPTION OF THE PREFERRED EMBODIMENT

Figure 1:
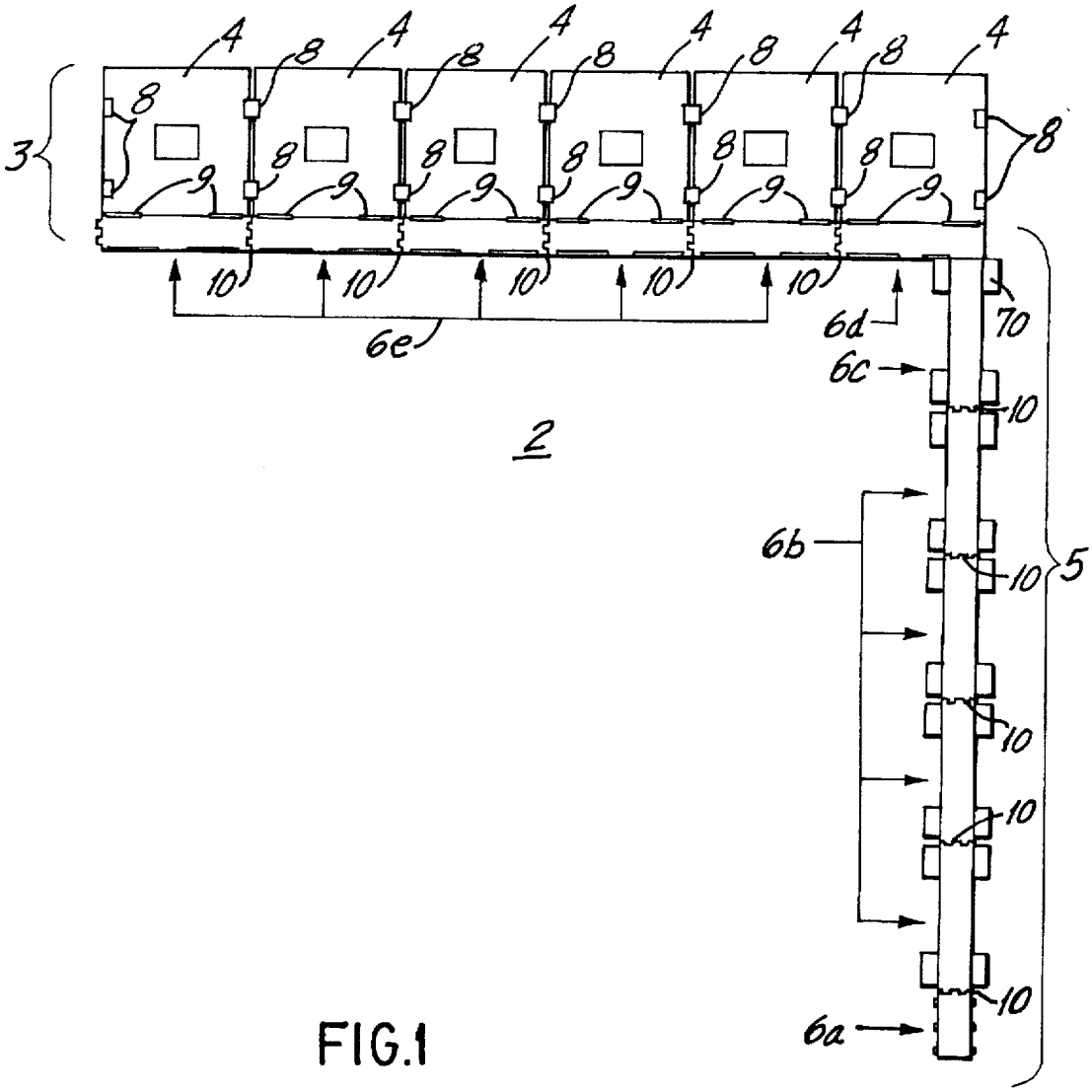
FIG. 1 is a top plan view of a preferred embodiment modular pump barge and walkway system.

The preferred embodiment modular pump barge and walkway system will now be described in detail. FIG. 1 illustrates a modular pump barge and walkway system 2 comprising a modular pump barge subsystem 3 and a modular walkway subsystem 5. The pump barge subsystem 3 comprises six identical modular pump barges 4. The number of barges 4 used in any system will of course vary according to the pumping requirements of a particular application. The barges 4 are shown interconnected to each other in serial fashion by link connectors 8, which will be described below in greater detail.

The walkway subsystem 5 comprises a plurality of modular walkways 6, in particular a shore walkway 6*a*, four identical span walkways 6*b*, a span interconnecting walkway 6*c*, a barge interconnecting walkway 6*d*, and five identical barge walkways 6*e*. The shore walkway 6*a* is suited to allow passage from the shore onto the span walkways 6*b*. The number of span walkways 6*b* will vary according to the distance that the barges 4 are placed from the shore. The connecting walkways 6*c* and 6*d* provide a transition from the span walkways 6*b* to the barge walkways 6*e*. The barge walkways 6*e* allow passage amongst the barges 4, and will vary in number according to the number of barges 4 required for a particular site application. The walkways 6 are generally interconnected to each other by hinge connectors 10, which will be described below in greater detail.

The pump barge subsystem 3 and the walkway subsystem 5 are connected to each other by conventional rope and cleat tying arrangements 9 as will be described further below.

Figure 2:
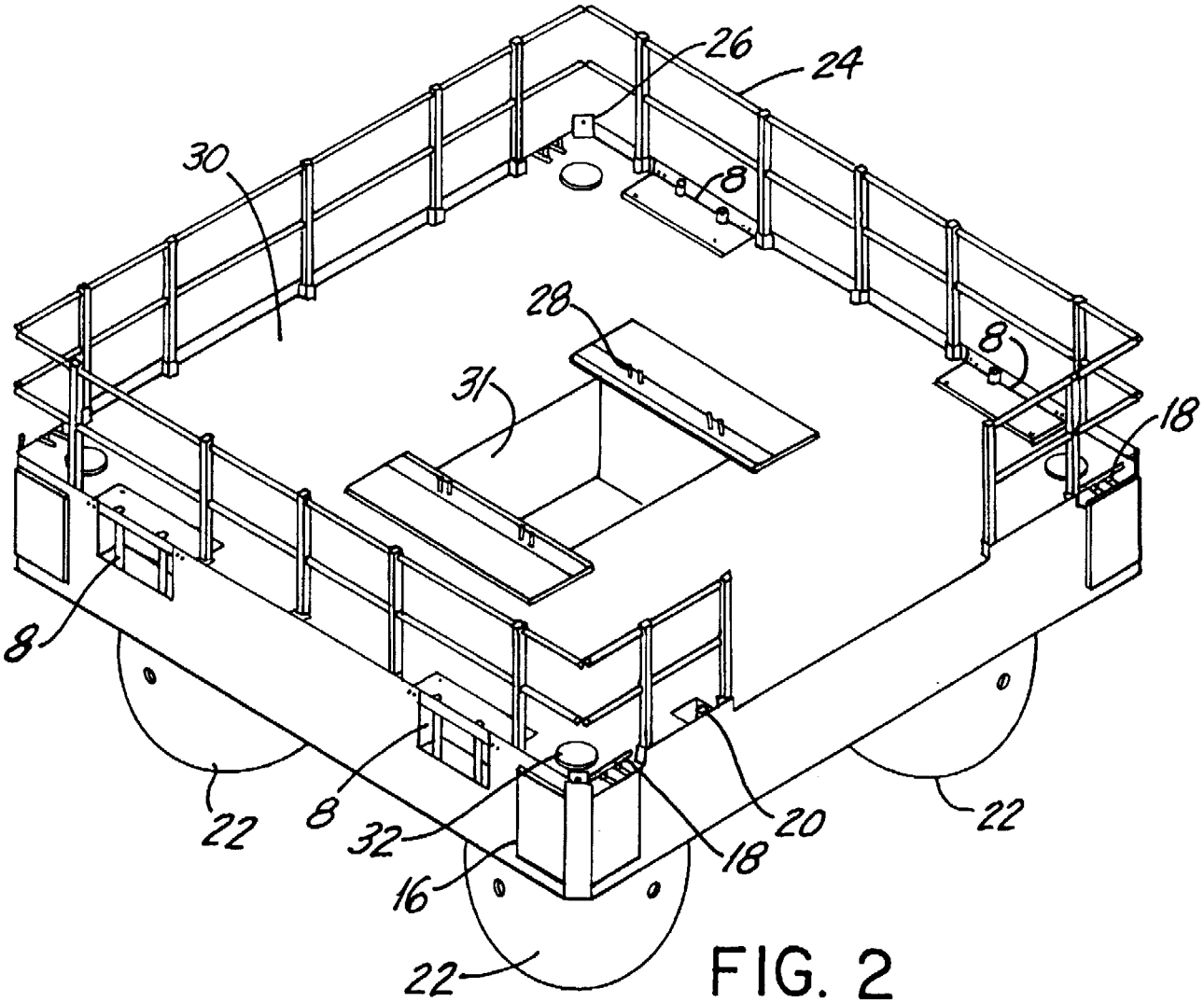
FIG. 2 is a perspective view of a pump barge used in the system of FIG. 1.

The pump barge 4 is shown generally in FIG. 2. The barge 4 is of molded construction and comprises a fiberglass reinforced plastic (FRP) shell consisting of an epoxy vinyl ester resin such as that sold under the tradename DERAKANE 441, with chopped strand and outer layers of woven roving with a gel coat. A foam core is made up of closed cell two component urethane block and pour foam. The barge 4 comprises a fabricated fiberglass deck 30 mounted on four standoffs 22. The top of the deck 30 has a recess 31 and eight mounting studs 28 for mounting of a pump (not shown). The number of mounting studs 28 may vary in accordance with the requirements of a particular pump application. A handrail 24 is mounted on four sides of the barge 4 with an opening to the mating walkway 6*d* or 6*e*. Each corner of the barge 4 has an integral lifting lug 26 for hoisting of the barge by a crane or the like during installation and removal. A light post socket 20 is located near the handrail opening and provides for a mount for overhead lighting (not shown). Bumpers 16 are located at each corner for proper positioning of the barge 4 with respect to other barges 4 and walkways 6. Tie-down cleats 18 are provide at each corner to allow interconnection between the barge 4 and its corresponding walkway 6*e* or 6*d*. An access cover 32 is shown which allows access to a leveling cavity located within each corner of the barge 4. The leveling cavities are used to contain resin-encapsulated lead ballast, which aids in leveling of each barge 4 after installation.

Figure 3:
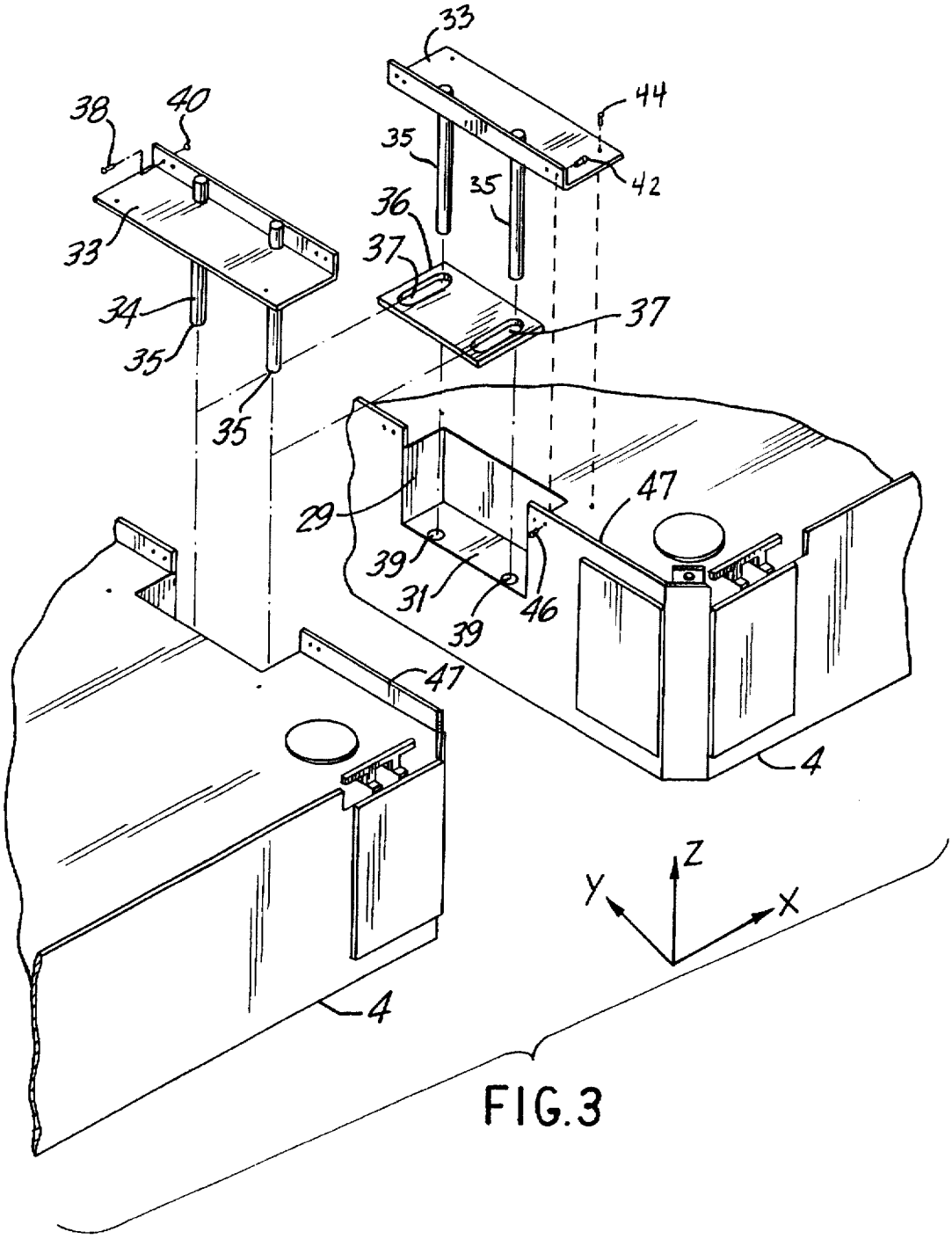
FIG. 3 is an exploded view of the interconnection between adjacent pump barges in the system of FIG. 1.
Figure 4:
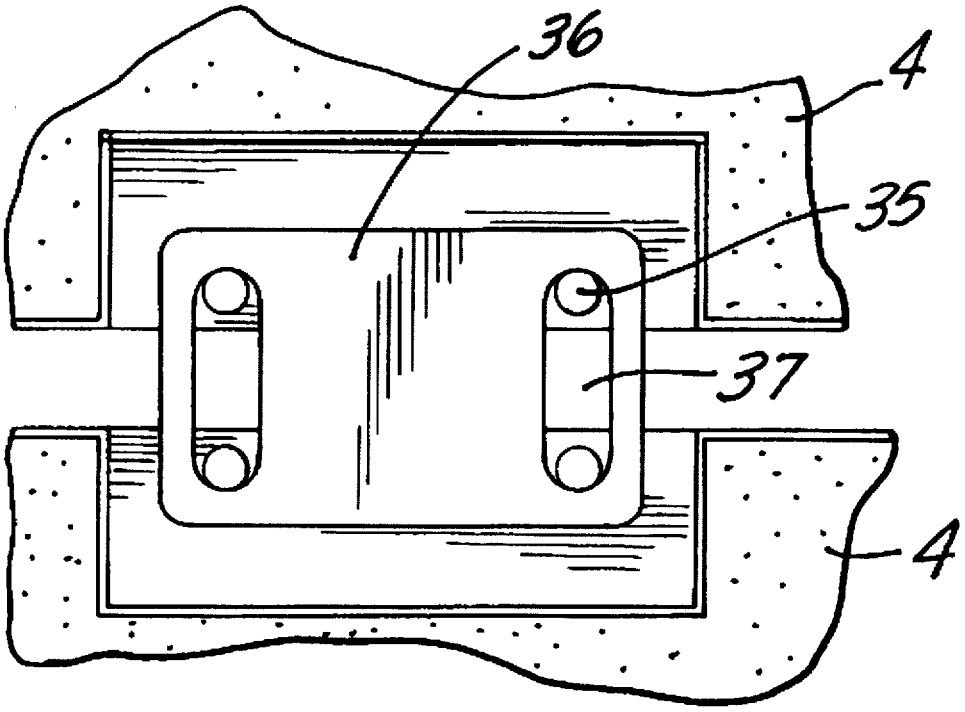
FIG. 4 is a top plan view of the pump barge connection link assembly of the system of FIG. 1.

Each barge 4 is provided with four link connectors 8 as shown in FIG. 2. FIG. 3 illustrates the connection of two adjacent barges 4. The link connector 8 comprises a link pin assembly 34 which comprises a support plate 33 and a pair of pins 35 which are disposed perpendicularly thereto. The link pin assembly 34 is connected to and removed from a recess 29 of the barge 4 by means of a pair of bolts 44, which are inserted vertically into the deck 30, and four bolts 46, which are inserted horizontally between a kickplate 47 and the link pin assembly 34 as shown. In order to connect two adjacent barges 4, the link pin assembly 34 is removed from each barge 4 and a link plate 36 is inserted so that the subsequent attachment of the link pin assembly 34 to the barge 4 will cause the pins 35 to pass through slots 37 of the link plate 36 and into associated holes 39 in a bottom shelf 31 of the recess 29 in the barge 4. The same pin insertion process is repeated for the adjacent barge 4, and the two barges are interconnected by the slidingly engaged link plate 36 accordingly. This connection process is of course carried out at the same time for both link connectors 8 existing on each side of the barges 4 to be connected. Thus, one link plate 36 is used to connect adjacent link connectors 8 for each interconnection of adjacent barges 4 in the system.

The link connectors of the present invention are advantageous insofar as they allow vertical translation of individual barges with respect to adjacent barges due to the vertical freedom (i.e. along the z-axis of FIG. 3) of the pin/link combination without allowing appreciable horizontal rotation between barges (i.e. along the y-axis). In addition, individual barges may be removed if required (e.g. for maintenance, replacement, etc.) without having to disassemble the entire system. That is, by disassembling the proper link connectors 8, the barge 4 may be removed and another one inserted in its place. In addition, the links of the present invention allow the barges to be maintained in relation to each other yet allow independent vertical movement of any barge. This is particularly useful when less than the full set of pumps are operated at one particular time. For example, if one pump is turned on and the other pumps are left in the off state, the barge which is operational will tend to sink in relation to the other barges. The vertical freedom obtained by the present link connection allows this independent vertical translation to occur.

Turning to the walkway subsystem 5, the hinge connectors 10 used to interconnect adjacent walkways 6 are common to the walkway configurations and are shown in detail in FIGS. 5 through 8. As used herein, the designation "walkway 6" refers to a typical walkway with elements common to all walkways 6*a*, 6*b*, 6*c*, 6*d* and 6*e*. Except where noted below, each walkway 6 is provided with interlocking pivoting hinge type assemblies at opposite ends for interconnection with other walkways in a serial manner. Walkway 6 has at one end a pair of semicircular hinge members 58 disposed with three gaps 56 as shown in the Figures. At the other end of the walkway 6 are three semicircular hinge members 54 spaced by two gaps 60. The hinge members 58 are disposed to mate with the opposing gaps 60, and the hinge members 54 are disposed to mate with the opposing gaps 56 to form a hinge-like configuration.

Each hinge member 54 and 58 has bored therethrough a circular opening 62. When the hinge members are aligned properly, a hinge pin 50 may be inserted through the entire assembly along with spacing washers 52. The hinge pin 50 is kept in place by means of a pair of bolts 64 and nuts 66.

The walkway hinge members 54 and 58 are of integral construction with the walkway 6. This allows for quick and simple interconnection of walkways as required. By using the interconnecting hinge members as shown, loads on any one walkway are distributed throughout the walkway subsystem, leading to increased stability.

Of critical importance in the present invention is the use of a material which is resistant to corrosion in solvents typically found in leaching ponds. Thus, the integration of the hinge members 54 and 58 with the body of the walkway in the unitary construction of the present invention allows the hinge members 54 and 58 to be constructed of the preferred FRP material shown to have such advantageous anti-corrosive properties heretofore unachieved by platform or walkway interconnection methods of the prior art.

In order to enhance further the stability of the walkway system, outriggers 70 are used at each corner of walkways 6b and 6c. These outriggers 70 are integral with the shell of the walkways to provide the same anti-corrosive properties obtained thereby.

Figure 9A:
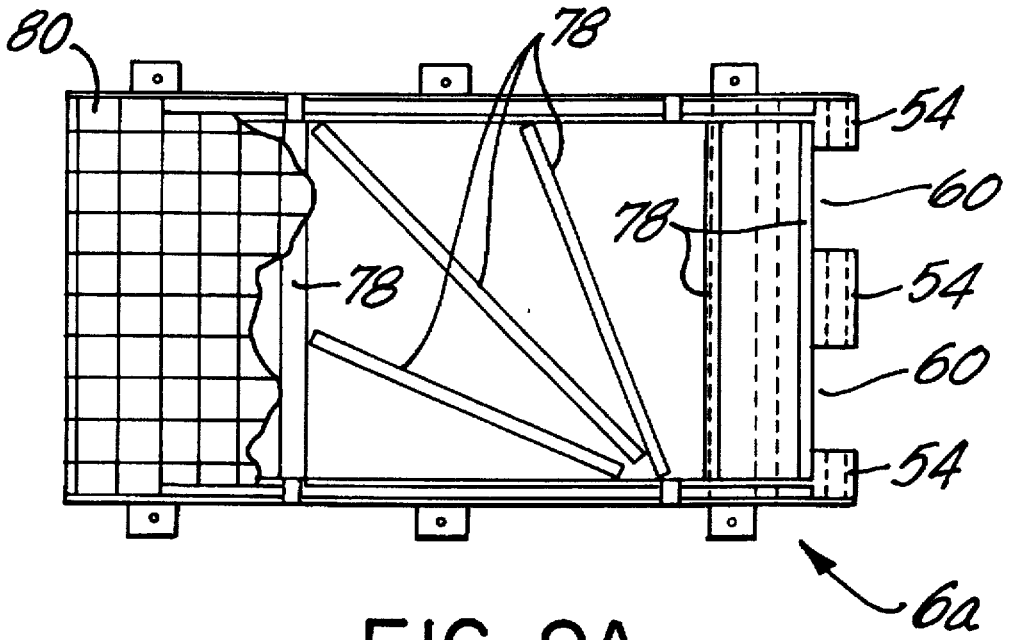
FIGS. 9(A) and 9(B) are top plan and side views, respectively, of a shore walkway used in the system of FIG. 1.
Figure 9B:
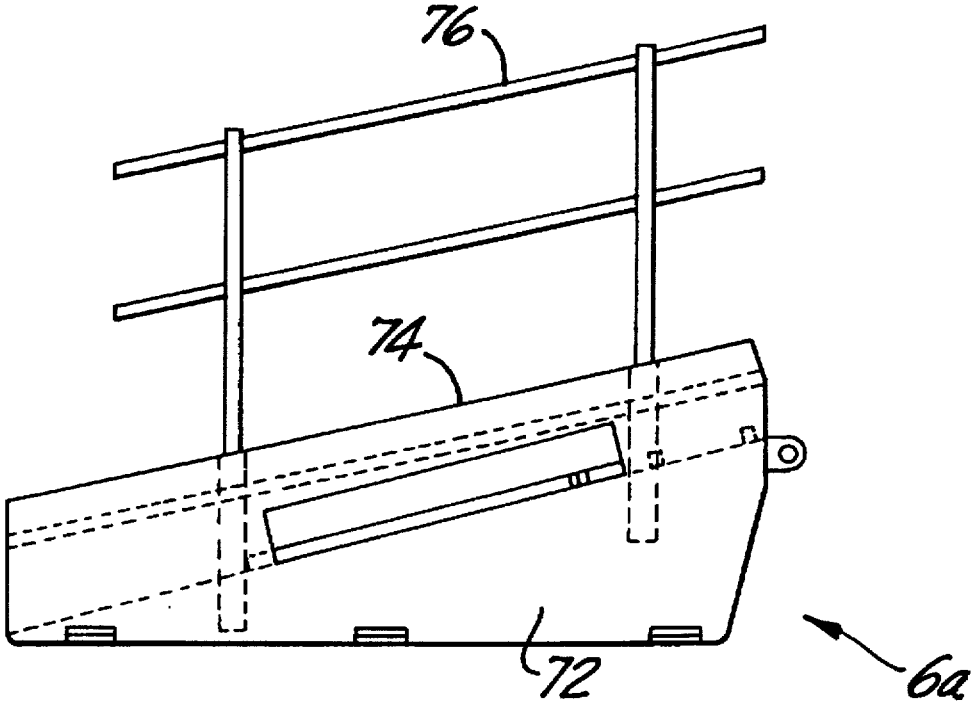

FIGS. 9(A) and 9(B) show the shore walkway 6a used in the present invention. This walkway is comprised of a body 72 with an upwardly sloping top 74 to allow easy transport between the shore and the span walkways 6b. A removable railing section 76 is attached on each side of the walkway 6a. The shore walkway 6a is hinged at only one end as shown in the Figures.

Figure 10A:
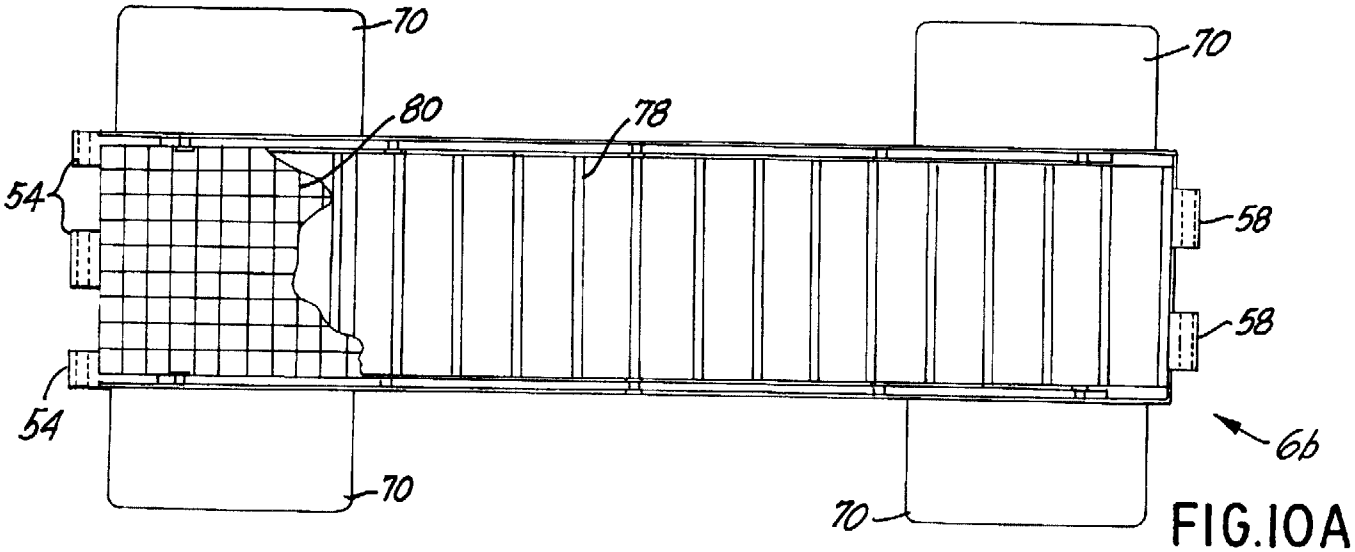
FIGS. 10(A) and 10(B) are top plan and side views, respectively, of a span walkway used in the system of FIG. 1.
Figure 10B:
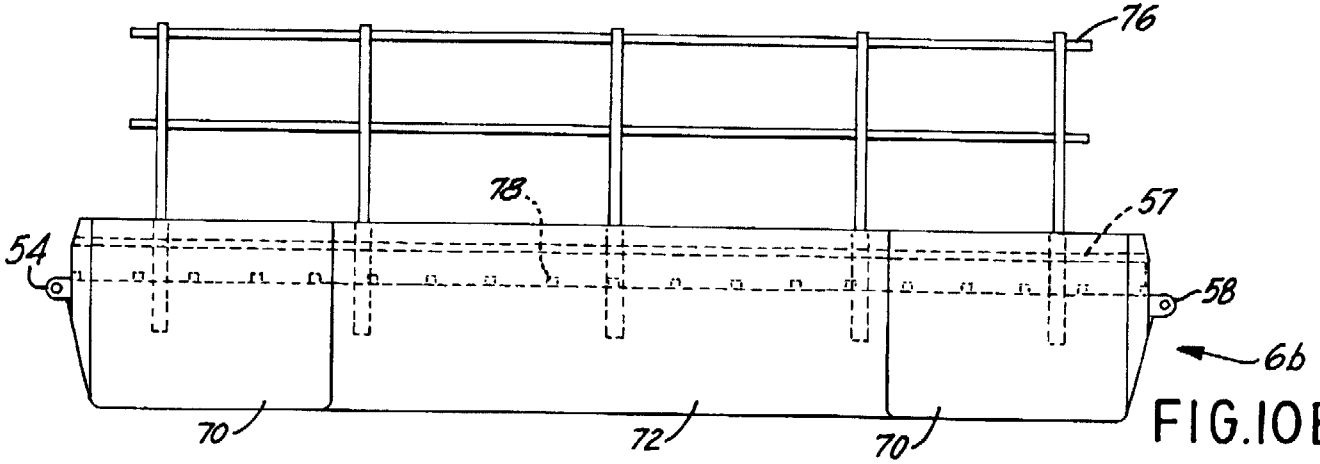

Common to all walkways 6 is the use of cable struts 78, which are generally laid across the width of the walkway 6 as shown for example in FIGS. 10(A) and 10(B) to provide support for the electrical cables (not shown) which run from the pumps mounted on the barges 4 onto the shore. A grating 80 is laid atop a pair of oppositely disposed shoulders 57, leaving a rectangular cross-sectional gap between the bottom of the grating 80 and the cable struts 78 for placement therethrough of the cables. The grating 80 is of open lattice construction to allow for the passage therethrough of air for cooling of the cables.

FIGS. 10(A) and 10(B) show the span walkway 6b used in the present invention. Outriggers 70 are located at each corner of the walkway in order to provide floating stability. The span walkway 6b has hinge members at both ends in order to allow interconnection of as many such walkways in serial fashion, as required by the location of the pump barges in the leaching pond relative to the shore.

Figure 11A:
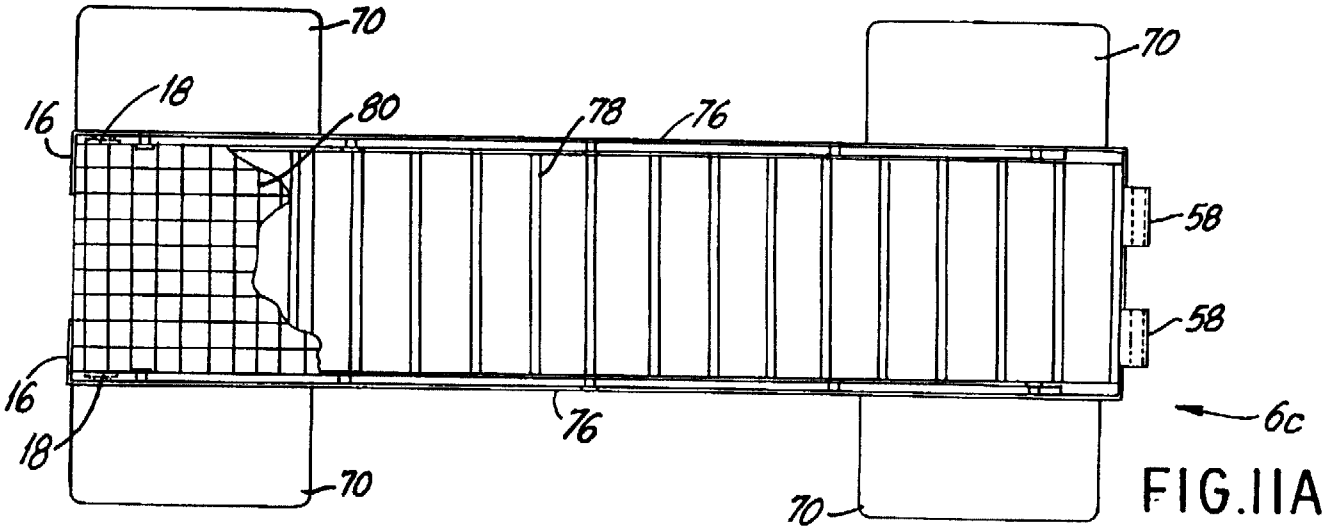
FIGS. 11(A) and 11(B) are top plan and side views, respectively, of a span interconnecting walkway used in the system of FIG. 1.
Figure 11B:
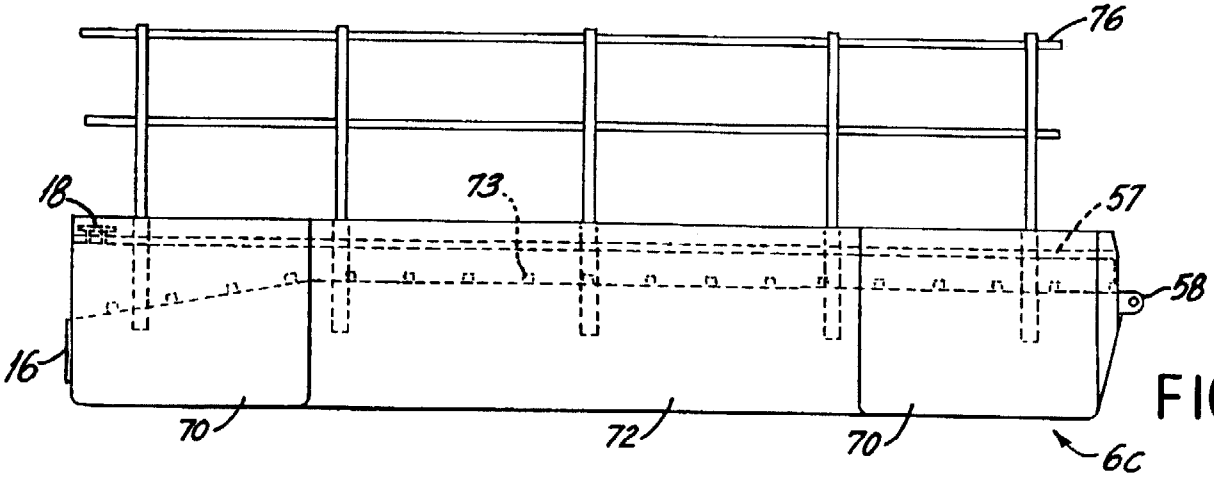

FIGS. 11(A) and 11(B) show the span interconnecting walkway 6c. At one end of the span interconnecting walkway 6c are hinge members 58 for interconnection with a mating span walkway 6b. At the opposite end are a pair of bumpers 16 and a pair of cleats 18, which allow interconnection by rope with an adjacent barge interconnecting walkway 6d at a right angle as shown in FIG. 1. Outriggers 70 are also located at each corner for floating stability in the same manner as the span walkways 6b.

Figure 12A:
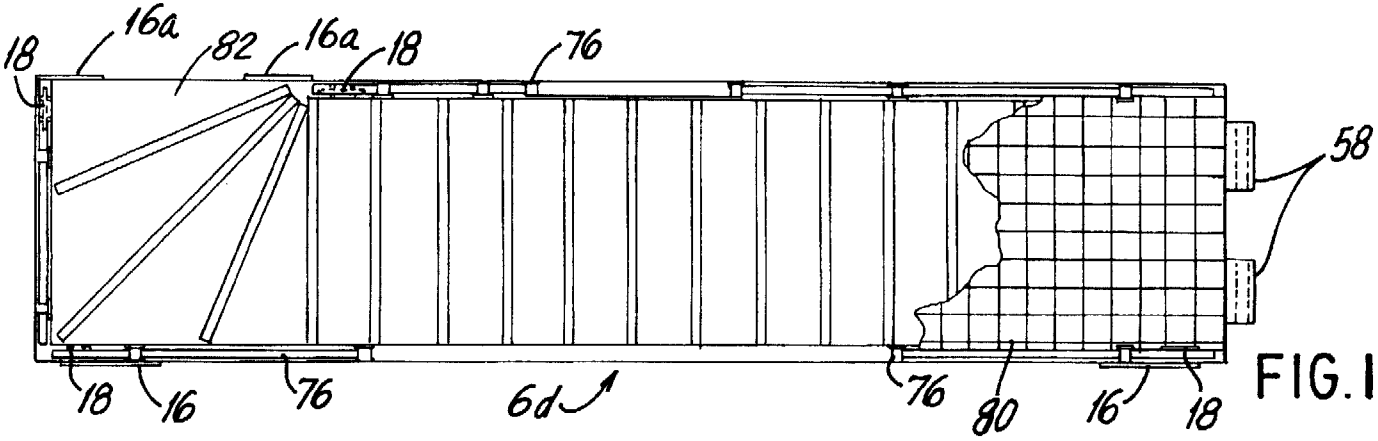
FIGS. 12(A) and 12(B) are top plan and side views, respectively, of a barge interconnecting walkway used in the system of FIG. 1.
Figure 12B:
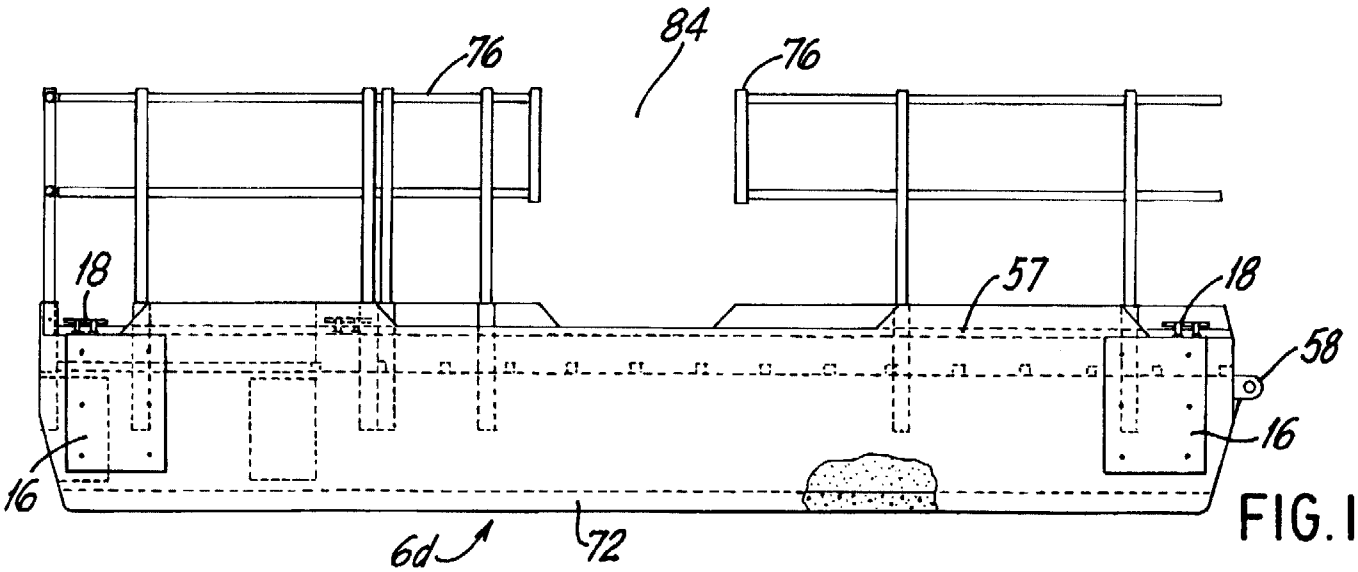

FIGS. 12(A) and 12(B) show the barge interconnecting walkway 6d, which is designed to mate at a right angle with the span interconnecting walkway 6c as shown in FIG. 1. Thus, a pair of bumpers 16a butt against the bumpers 16 on the span interconnecting walkway 6c, and ropes are used to tie together the adjoining cleats 18. An opening 82 is provided in the handrail sections 76 such that passage between the adjacent walkways is made possible. Hinge members 58 are provided for hinged interconnection with an adjacent barge walkway 6e. A second pair of cleats 18 are provided at opposite ends to allow tying by rope of the walkway 6d to an adjacent barge 4 as shown in FIG. 1. An opening 84 is also provided in the handrail section 76 to allow passage between the walkway 6d and the adjacent barge 4.

Figure 13A:
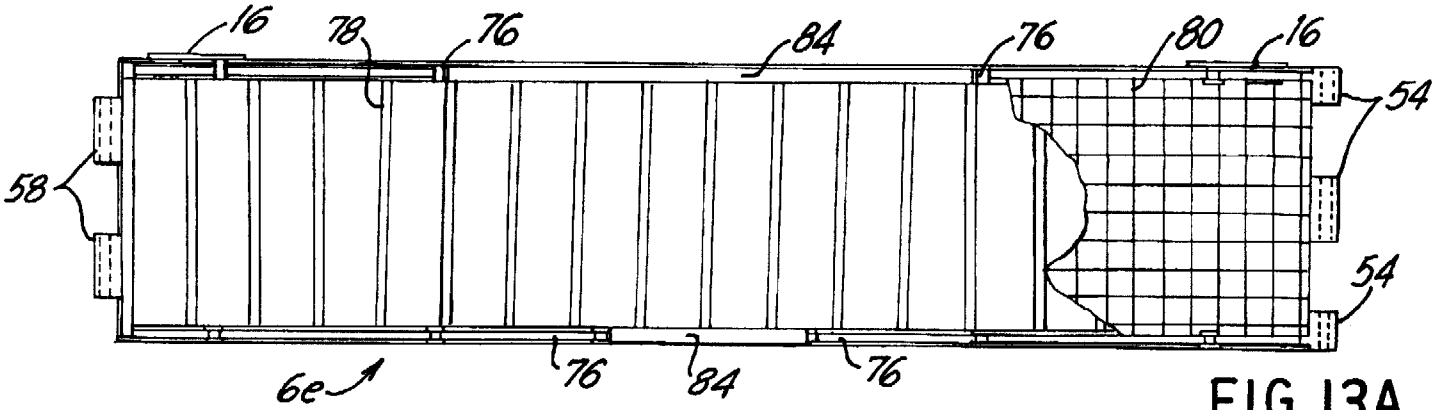
FIGS. 13(A) and 13(B) are top plan and side views, respectively, of a barge walkway used in the system of FIG. 1.
Figure 13B:
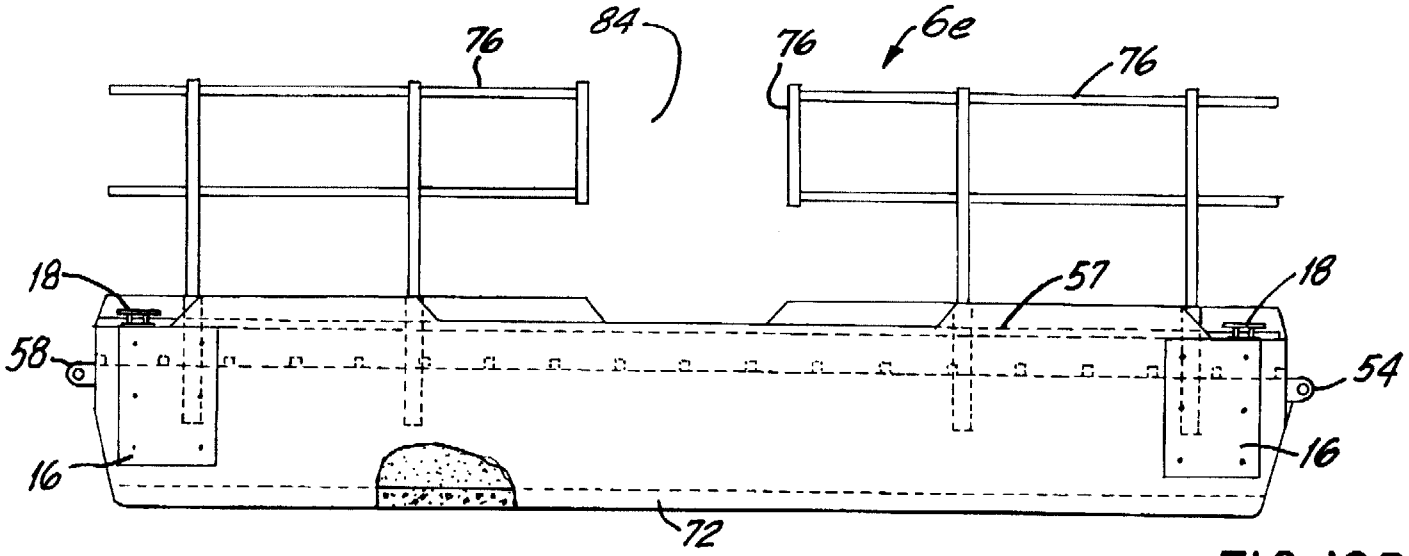

FIGS. 13(A) and 13(B) show a barge walkway 6e. The barge walkway 6e has hinge members 54 and 58 at opposite ends for mating with adjacent barge walkways 6e or with an adjacent barge interconnecting walkway 6d as shown in FIG. 1. A pair of bumpers 18 are provided to butt against an adjacent barge 4, and a pair of cleats 18 are provided to be tied by rope with adjoining cleats 18 on the barge 4. A pair of openings 84 are provided in the handrail section 76 to allow passage therethrough of an operator (onto the barge 4) as well as to allow passage therethrough of a pipe from the pump on the barge 4 (not shown).

Figure 5A:
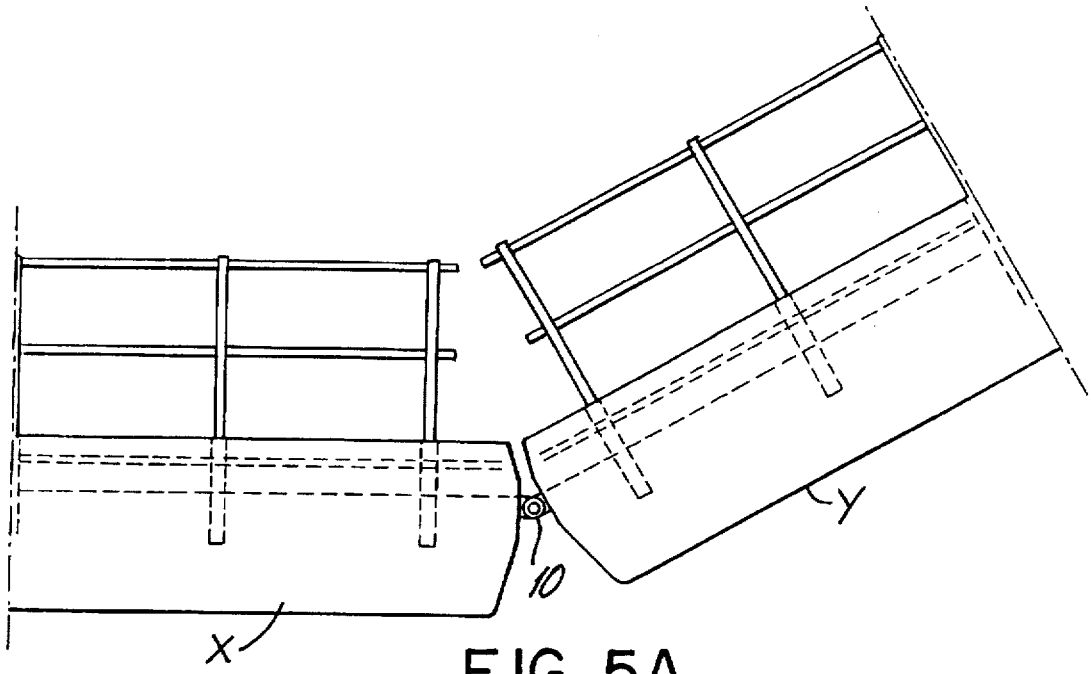
FIG. 5 is a side view of the hinged interconnection of two typical walkways used in the system of FIG. 1.
Figure 5B:
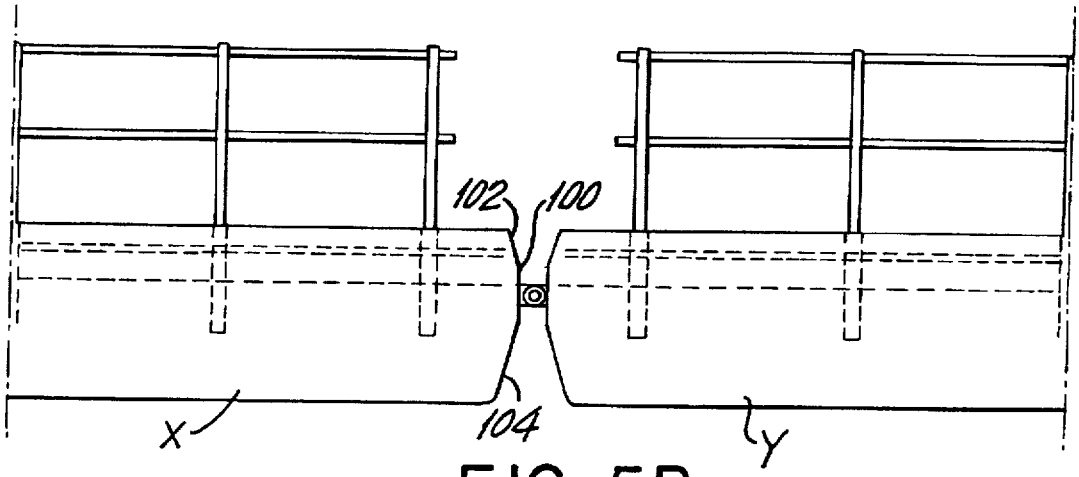
Figure 6:
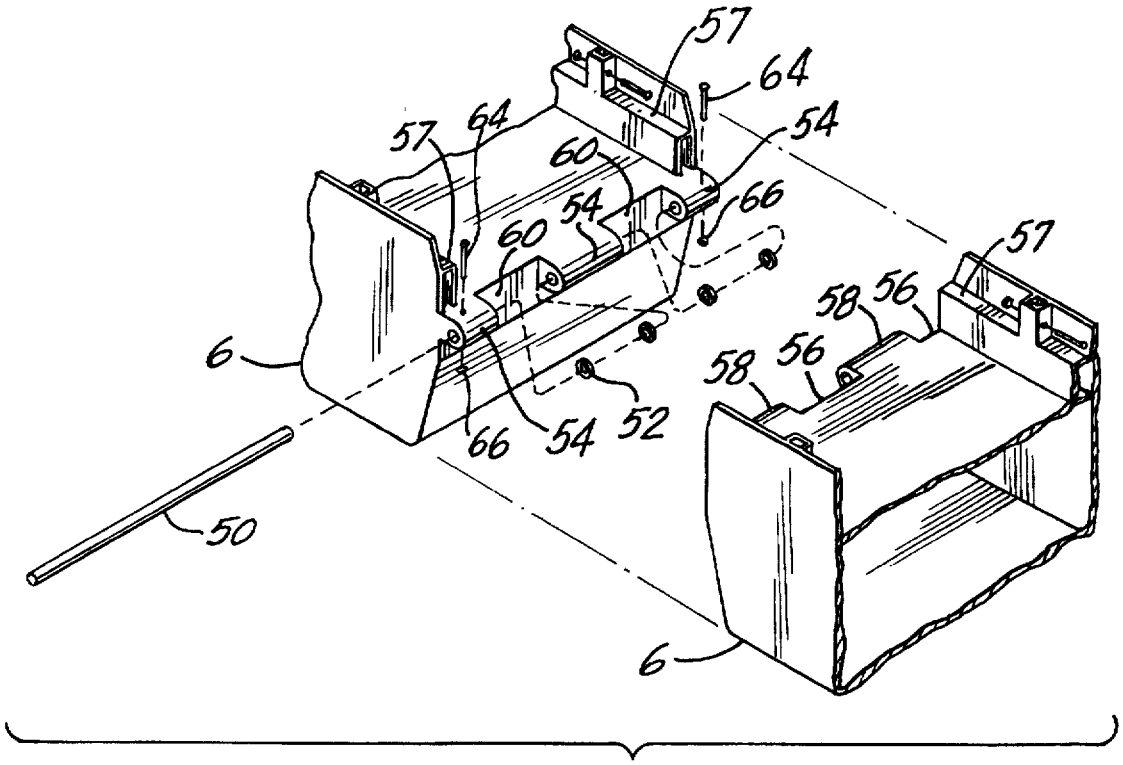
FIG. 6 is an exploded view of the interconnection hinge between adjacent walkways in the system of FIG. 1.
Figure 7:
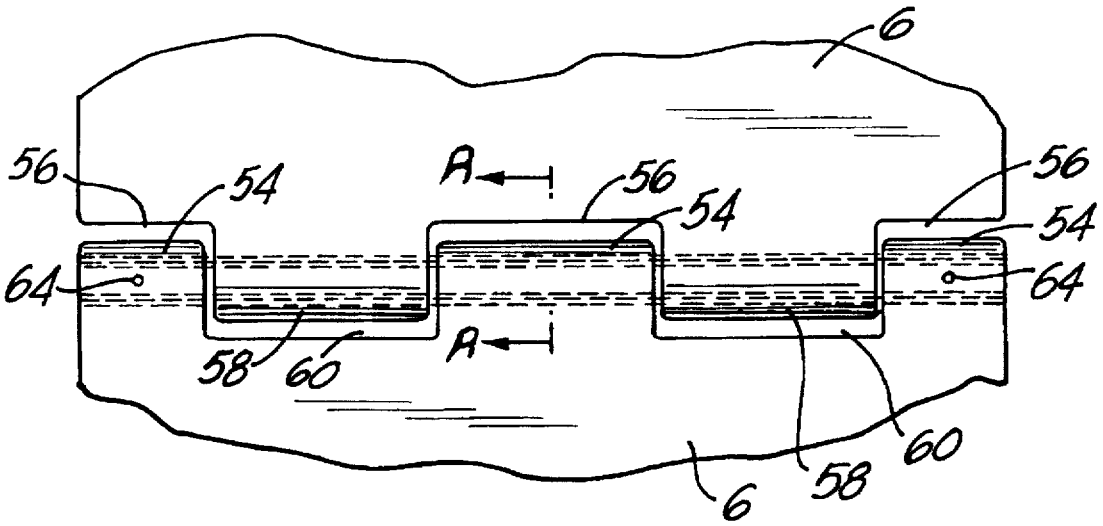
FIG. 7 is a close-up top plan view of the hinge assembly of the walkway of FIG. 5.
Figure 8:
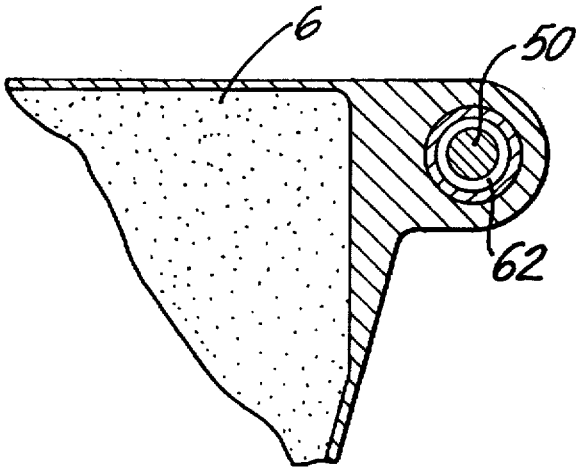
FIG. 8 is a side view of the hinge assembly of FIG. 7 taken along line A—A.

FIG. 5 is a side view of two typical walkway hinge sections interconnected in pivotal assembly in accordance with the present invention. As can be seen by the cross-sectional profile of each walkway, an upper wall 102 is tapered with respect to end wall 100, and a lower wall 104 is similarly tapered with respect to the end wall 100. This allows clearance for relative rotation of walkways X and Y about the hinge interconnection as seen in FIG. 5. Thus, each walkway can pivot as required by the site conditions; i.e. the lay of the shoreline, the depth of the leaching pond (which changes over time), etc.

Conventional rope and cleat tying arrangements are used where indicated above to allow subsystems of the system 2 (i.e. the subsystem of walkways 6a, 6b, and 6c; the subsystem of walkways 6d and 6e; and the subsystem of barges 4) to be quickly and easily disconnected from each other. Thus is useful for example when the level of solvent in the leaching pond has reached a low point and the barges have bottomed out.

Although the modular pump barge and walkway system of the present invention has been described herein with reference to the preferred embodiment, it is understood that alternative embodiments are within the spirit and scope of the invention. Thus, other walkway layout may be desired, for example, when the system layout dictates openings on different sides for access in different arrangements, etc.

We claim:

1. A system for the closely spaced interconnection of a pair of adjacent floating barges, each of said barges having a top deck and four side walls, at least one of said side walls having a recess disposed therein, each recess having a bottom shelf with a pair of holes disposed therein, said system comprising:

(a) a link pin assembly associated with each barge, said link pin assembly comprising a support plate and a pair of pins disposed perpendicularly thereto, said support plate arranged so as to be removably attachable to said top deck so as to cover said recess, said pins being disposed so as to be mated with and removably inserted into the pair of holes disposed within the bottom shelf of said recess when said support plate is attached to said top deck; and (b) a link plate comprising a pair of parallel slots juxtaposed so as to allow placement therethrough of said pins of said link pin assembly, said link plate being removably and slidably inserted between said support plate and said bottom shelf of said recess when said link pin assembly is attached to said barge;

wherein, when said link plate is slidably inserted between the support plate and the recess bottom shelf of each adjacent barge, said link plate provides interconnection of said barges with independent vertical translational movement therebetween.

2. A modular barge system comprising a plurality of floating barges, each barge comprising four side walls, at least two oppositely disposed of said side walls comprising means for slidably engaging a link connection plate for interconnection with an adjacent barge, wherein said slidably engaged link connection plate provides independent vertical translational movement between the barges, in which said side walls comprise a recess and in which said engagement means comprise a pair of parallel disposed pins, said pins being removable from said recess to allow insertion therethrough of said link connection plate.

3. The modular system of claim 2 in which each of said two oppositely disposed side walls comprise a pair of said engagement means.

4. A floating barge comprising:

(a) a top deck;

(b) four side walls, wherein each of two oppositely disposed side walls have a pair of recesses disposed therein, each recess having a bottom shelf with a pair of holes disposed therein:

(c) a link pin assembly associated with each recess, said link pin assembly comprising a support plate and a pair of pins disposed perpendicularly thereto, said support plate arranged so as to be removably attachable to said top deck so as to cover said recess, said pins being disposed so as to be mated with and removably inserted into the pair of holes disposed within the bottom shelf of said recess when said support plate is attached to said top deck; said barge further comprising in association therewith a link plate comprising a pair of parallel slots juxtaposed so as to allow placement therethrough of said pins of said link pin assembly, said link plate being removably and slidably inserted between said link pin assembly and said bottom shelf of said recess when said link pin assembly is attached to said barge so as to provide independent vertical translational movement between said link plate and said barge.

* * * * *

UNITED STATES PATENT AND TRADEMARK OFFICE

CERTIFICATE OF CORRECTION

PATENT NO. : 5,697,313

DATED : December 16, 1997

INVENTOR(S) : Dennis W. Horn and Matthew Sheperd

It is certified that error appears in the above-identified patent and that said Letters Patent is hereby corrected as shown below:

In claim 4, column 7, line 5, after "therein", the colon should be deleted and replaced with –; and–

Signed and Sealed this

Twenty-fourth Day of February, 1998

*Attest:*

Bruce Lehman

BRUCE LEHMAN

*Attesting Officer*

*Commissioner of Patents and Trademarks*